United States Patent [19]

Ek et al.

[11] Patent Number: 4,722,152

[45] Date of Patent: Feb. 2, 1988

[54] METHOD AND APPARATUS FOR GRINDING THE SLIDING SURFACE OF SKATES

[76] Inventors: Robert Ek, Odlingsvägen 46, S-342 00 Alvesta; Henry Bergstedth, Morkullevägen 12, S-360 15 Hovmantorp, both of Sweden

[21] Appl. No.: 771,876

[22] Filed: Sep. 3, 1985

[30] Foreign Application Priority Data

Sep. 3, 1984 [SE] Sweden ..... 8404396

[51] Int. Cl.[4] ..... B24B 9/04

[52] U.S. Cl. ..... 51/165.71; 51/34 E; 51/281 R; 51/285

[58] Field of Search ..... 51/165.71, 165.77, 165.8, 51/165.83, 165.91, 281 R, 285, 51, 34 E

[56] References Cited

U.S. PATENT DOCUMENTS 3,735,533 5/1973 Salberg ..... 51/34 E 4,523,409 6/1985 Defasio ..... 51/165.71

4,596,091 6/1986 Daboudet et al. ..... 51/101 LG

*Primary Examiner*—Robert P. Olszewski

*Assistant Examiner*—Maurina Rachuba

*Attorney, Agent, or Firm*—Pollock, Vande Sande & Priddy

[57] ABSTRACT

An automatic sharpening of the slide surface of a skate to desired profile with regard to at least two dimensions x and y in a coordinate system is disclosed. A grinding wheel is by guide means movable in x-direction in the longitudinal direction of the slide surface and by guide means movable in y-direction. Firstly, a scanning of the existing profile of the slide surface is carried out by means of the grinding wheel which with a substantially constant abutment pressure forceably is moved along the slide surface, during which movement the x- and y-coordinates of the profile are continuously recorded in a memory. After eventual correction of the coordinates in the memory the grinding is carried out by forcing the grinding wheel in rotating state to repeat the recorded coordinates upon impulses from the memory.

10 Claims, 10 Drawing Figures

METHOD AND APPARATUS FOR GRINDING THE SLIDING SURFACE OF SKATES

BACKGROUND OF THE INVENTION

The present invention relates to a method and apparatus for automatically grinding the sliding surface of a skate to a desired profile with regard to at least two dimensions x and y in a coordinate system, in which a rotatable grinding wheel is movable in x-direction along the length extension of the sliding surface and in y-direction in an angle thereto by means of guiding means.

Advanced skaters and experts have found that the individual skate-style demands a particularly formed sliding surface for the skates. The sliding surface can be regarded as a grind profile—the outer contour of the sliding surface in a lateral view—and as the grind cross section—the sliding surface in a section from the front. Grind profile and grind cross section do not need to by symmetrically equal for right and left skate. It has also recently been discovered, that the sliding effect of the skate increases if a straight sliding surface is ground in existing grind profile. Thus, the sliding surface for each skater, particularly professional skaters is unique, and demands extensive experimental work to be found out by experiment.

Particularly in connection with ice-hockey, bandy and speed-skating, it hs been discovered, that the sharpening degree of the sliding surface is of importance for the sliding resistance of the skate, for example a too sharp sliding surface yields partially high contact pressure which tends to deform the ice in a way unfavourable for the sliding resistance. This deformation depends of course on the hardness of the ice but above all on the force that the skater develops during the skating.

When a skater has discovered the grinding best suited to his skating and the ice surface, it is of greatest importance, that the grind profile and the grind cross section be maintained when resharpening the skate slide surface.

Skate grinding presently demands an expert who manually grinds the sliding surface of the skate. For grinding a straight sliding surface a number of "planning models" having different long straight surfaces exist. The exact grind profile is impossible to obtain or maintain. A sliding surface as individually formed as possible can with this manual method be produced today.

U.S. Pat. No. 3,735,533 discloses an automatically operating grinding or sharpening machine for skates. This machine is, however, only manufactured as a coin-operated automatic machine for grinding two skates after the correct number of coins has been inserted into a coin-mechanism. The machine is very comples, since it requires a multitude of controls. It can nevertheless only grind in accordance with a fixed program and performs only hollow grinding (concave cross-section). The number of times the grinding wheel performs depends upon which switch has been selected, "good", "fair" or "poor" and that a correct number of coins has been inserted. The grinding direction is always the same.

The main object of the present invention is to provide a technique which allows an automatically performed mechanical sharpening of a skate slide surface as well as controlled individual change of grind profile and/or cross-section of the skate.

Another object of the invention is to provide a method which provides optional detailed configuration of grind profile and grind cross-section.

A further object of the invention is to provide a method for maintaining a successful sliding surface through repeated sharpening.

Still another object of the invention is to provide a method for changing the skate grind profile with regard to the positioning of a desired straight sliding surface with minimum machining grinding on the skate blade.

Still another object of the invention is to provide a method that can be used over a long period of time without service with continued acceptable capability to sharpen and change the grind profile/grind cross-section of the skate blade.

Compared to the above mentioned known automatic skate sharpening machine the method and apparatus according to the present invention is essentially simpler and moreover all the different kinds of grinding, as individually desired, can be performed by the invention. The only requirement is to position the skate in an skate holder and thereafter start the grinding cycle via a manual starting device or, if the apparatus, according to the invention, should be constructed as a coin operated apparatus, a coin-accepting device. Thereupon, the existing profile of the skate blade is scanned. At the same time a recording of the measured x- and y-values takes place continuously in a memory, preferably an electronic memory, from a 0-position, which is the position where the grinding wheel, used for scanning first contacts the skate blade after movement in the y-direction from its starting position. From the 0-position, the grinding wheel is moved only in a contacting state without grinding during recording of the x- and y-values in the memory, and then returns to the 0-position. After correction of the measured x- and y-values in the memory to the desired profile, the grinding wheel is put into rotation and guided during grinding of the skate sliding surface with adequate machining (0.05–0.1 mm) along the path determined by the prerecorded corrected x- and y-values. A total grinding cycle to achieve the desired grinding profile can include several grindings with appropriate machining for each. The number of grindings can be choosen in advance.

The invention also provides for possible grinding of at least one straight slide surface along a part of the profile. This straight slide surface can optionally be positioned along the profile. The grind profile recorded in the memory is completed with at least two x-values (x1 and x2) from the 0-position using for instance a keyboard. The grinding takes place according to the recorded x- and y-values with the exception that the grinding wheel grinds along the shortest distance between the completed x-values. The number of grindings can be adapted so that machining to the desired grind profile (x, x1, x2, y) is obtained.

In addition to ordinary symmetric grind cross-section obtained by hollow grinding, the invention provides for displacement of the grinding in the z-direction of the coordinate system and accordingly an unsymmetrical grind cross-section is obtained, which is suited to certain skaters' skating style. Such a displacement is obtained in a simple way by arranging the grinding wheel to adjust in the z-direction.

The method according to the invention also provides for storage of an individual grind profile which can, for instance, be recorded on magnetic tape, for repeated use.

It is evident from the above discussion evident, that the method and apparatus according to the invention can be made more or less advanced. In one embodiment the x- and y-coordinates are recorded during scanning of the existing profile and the grinding takes place in accordance with this recording after correction to the desired profile. It is also possible to allow the apparatus to suggest a specific grind profile. In another embodiment the method of the invention also allows for guiding of the grind process with regard to the grind cross-section. Moreover, the invention provides for storage of the previously obtained desired grind profile for future repeated grinding.

BRIEF DESCRIPTION OF THE DRAWINGS

In the following description the invention is described in greater detail with reference to the accompanying drawings wherein.

DESCRIPTION OF THE PREFERRED EMBODIMENTS

Figure 1:
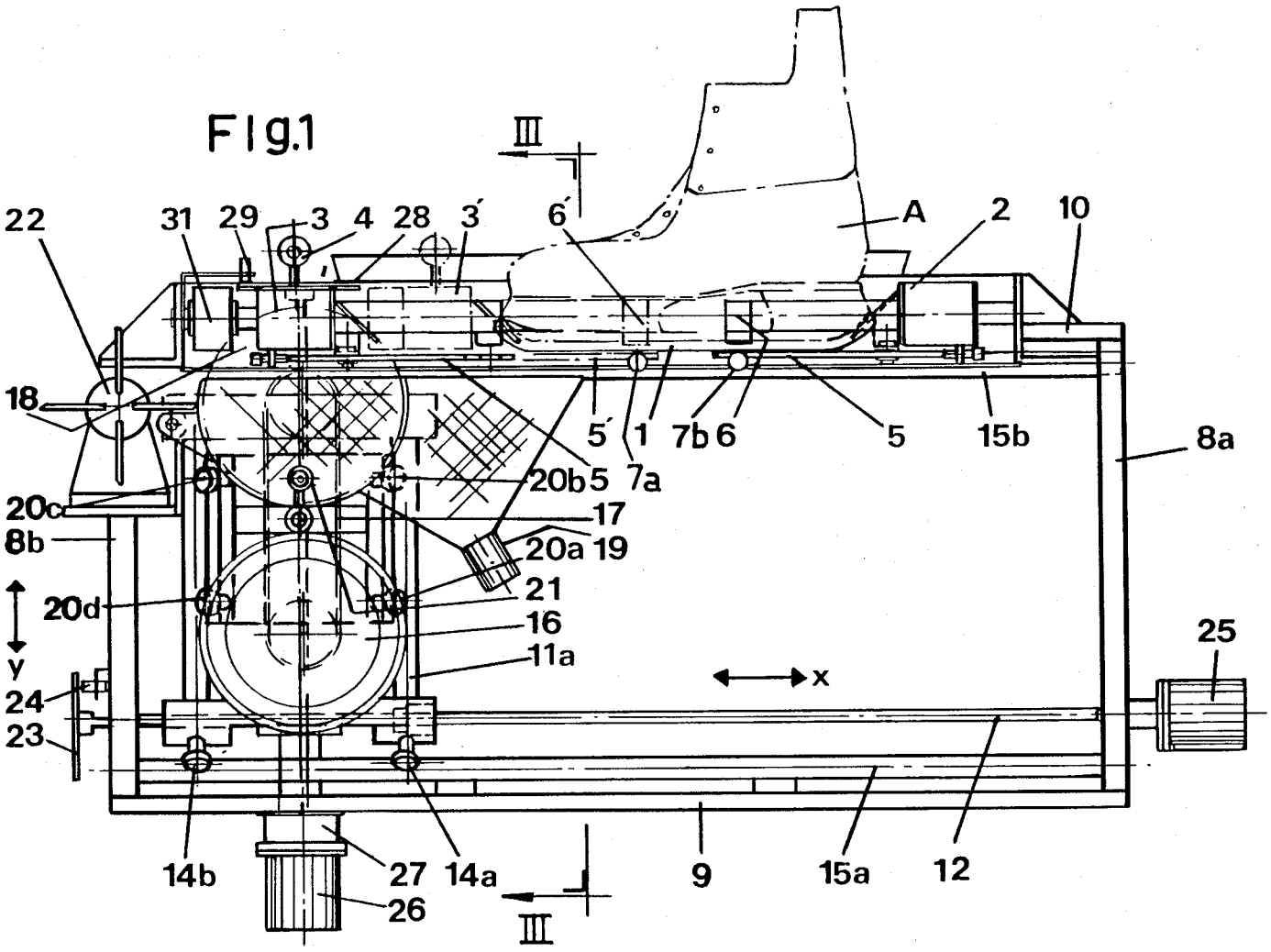
FIG. 1 is a side view showing an embodiment of a machine according to the invention having a skate inserted into a skate holder.
Figure 2:
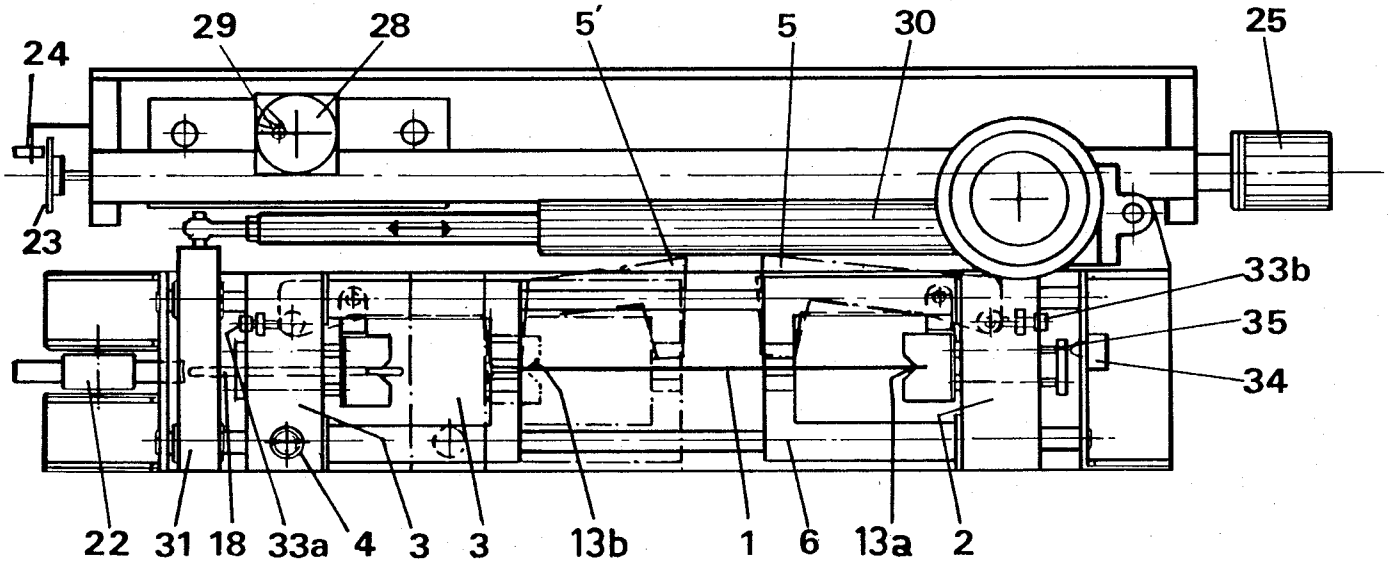
FIG. 2 shows the machine according to FIG. 1 from above and with the skate removed.
Figure 3:
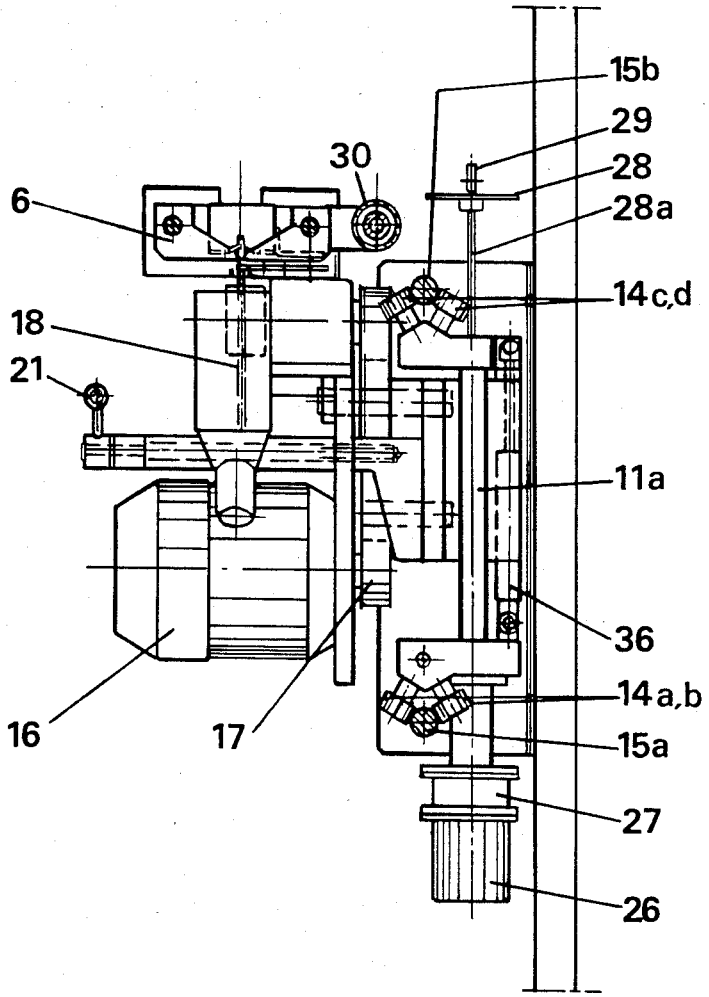
FIG. 3 is a section along the line III—III in FIG. 1 and with the skate removed.

The skate sharpening machine shown in FIGS. 1-3 consists of a holder 2, 3, 5, 6 for a skate A having a skate blade 1 and arranged in a stand 8*a*, 8*b*, 9, 10. A grinding device is also journalled in the stand and includes a grinding wheel 18 which is movable in both the x- and y-direction. The skate blade 1 is shown with its one end positioned in a recess 13*a* in the holder component 2, whereupon a manually operated holder component 3 is moved into abutment against the other end of the skate blade by handle 4 to the position 3' shown by dash-dotted lines, thereby positioning this end in a recess 13*b* in the holder component 3. Thereupon, a motor for driving device 30 (FIG. 2) is started and pulls a dog means 31 towards the holder component 3. At the same time as the dog means 31 is moved, the position for recording the length of the skate blade is indicated. Pivotally arranged heals 5, 5' in the holder support the skate blade 1 together with shoulders 6 included in the holder.

When the holder component 3 is pressed against the blade 1, the holder components 2 and 3 spring inwardly about 5 mm, which causes a breaker 34 to be influenced by guiding arms 35, thereby switching off the current to the drive means 30. At the same time as the holder components 2 and 3 spring inwardly, the support heals 5 and 5' are activated by set means 33*a* and 33*b*, which causes the heals 5 and 5' to be pivoted away to the position shown by dash-dotted lines in FIG. 2.

When the heals 5 and 5' are pivoted away, the electronic controls indicate that the skate is locked in a position for grinding. A motor 25 starts and moves the entire grinding device with the grinding wheel 18 in the x-direction during guidance of roller pairs 14*a*–*d* along guides 15*a*, 15*b*. When the periphery of the grinding wheel 18 reaches the front portion of the skate blade 1, the grinding device is pressed in the y-direction against the influence of a gas spring 36 which holds the entire weight of the grinding device in the cradle which is guided by roller pairs 20*a*–*d* along guides 11*a* and 11*b*. The gas spring 36 forces the grinding wheel to abut the skate blade with a substantially constant force independent of the position in the y-direction along the blade. See also FIG. 3. Such a resilient arrangement of the grinding unit, for instance as exemplified with the gas spring arrangement, with a constant pressure of the grinding wheel against the blade during the later scanning of the blade profile is a pre-requisite for correct scanning of the existing blade profile.

The motor 25 for movement of the cradle in x-direction via spingle 12 also drives, via the spindle, a marking disc 23 in cooperation with a pulse transmitter 24 for delivering pulses to the control center of the machine, where the length of the skate blade is stored in an electronic memory. Simultaneously as memory storage of the grinding wheel movement scanning in the x-direction takes place, a memory recording of the wheel movement in y-direction takes place by the rotation of stationary ball screw 28*a* (FIG. 3) during movement of the grinding unit in the y-direction. This screw also has a marking disc 28 and a pulse transmitter 29. Thus, from a 0-position, where grinding wheel 18 first is brought into contact with the skate blade after movement in the y-direction from its starting position, the existing profile of the skate blade is scanned during movement of the grinding wheel in only following state without rotation and during simultaneous continuous recording in memory of measured x- and y-values, whereafter the grinding wheel returns to the 0-position.

After correction of the measured x- and y-values in the memory to the desired profile, the grinding operation takes place. A motor 26 is connected to the screw 28*a* via an electric magnet 27. The grinding motor 16 drives the grinding wheel 18 via a transmission 17 and the grinding operation is started from the 0-position. The grinding wheel is, during the grinding of the slide surface of the skate, guided with appropriate machining grade along the path determined by the previously recorded and corrected x- and y-values. A total grinding cycle to achieve the desired grind profile can include several grindings with a machining grade for each grinding. The number of grindings can be pre-selected. After the required number of grinding movements the machine and holder components stop and return to the starting position. The skate is then removed from the machine and another skate is inserted and the recorded measuring and grinding process repeated.

Thus, during the measuring and scanning cycle, the connection between the ball screw mechanism 28*a* and the motor 26 is off and the ball screw mechanism is connected to the pulse transmitter 29 which records the movement of the grinding wheel 18 in y-direction. During the machining grinding cycle the connection between the ball screw mechanism and the motor is switched on and the earlier recorded pulses guide the driving of the motor for movement of the grinding wheel in y-direction synchronously with the recorded movement in x-direction.

The grinding process described above is one which can be performed in the simpliest machine built using the method according to the present invention. When performance of a more advanced grinding of a skate, for instance a change of grind profile or a displacement of a straight portion of the slide surface is desired, the machine can be completed with a guidance device for instance a key board.

The grind profile of the cross-section can also be varied by abutting different scrapers 32, arranged on a rotatable drum 22, against the grinding wheel 18 before the measuring and scanning cycle. After the periphery of the grinding wheel has adopted the form of the scraper, a certain maximum abutment force will be exceeded, which results in the ceasing of the scraping.

Grinding and displacement of the slide surface straight portion can to a limited extent also take place by use of a "standard grinding program", provided that an excenter mechanism 7 included in the skate holder is readjusted. In this instance a minimum of machining will take place in the front or back of the skate blade depending on where the displacement of the straight surface is desired.

FIGS. 1 and 3 also show exhausting means 19 which both collects and discharges machining and grinding particles to a collecting container. The exhausting means can preferably be connected to the suction side of a fan.

Figure 4:
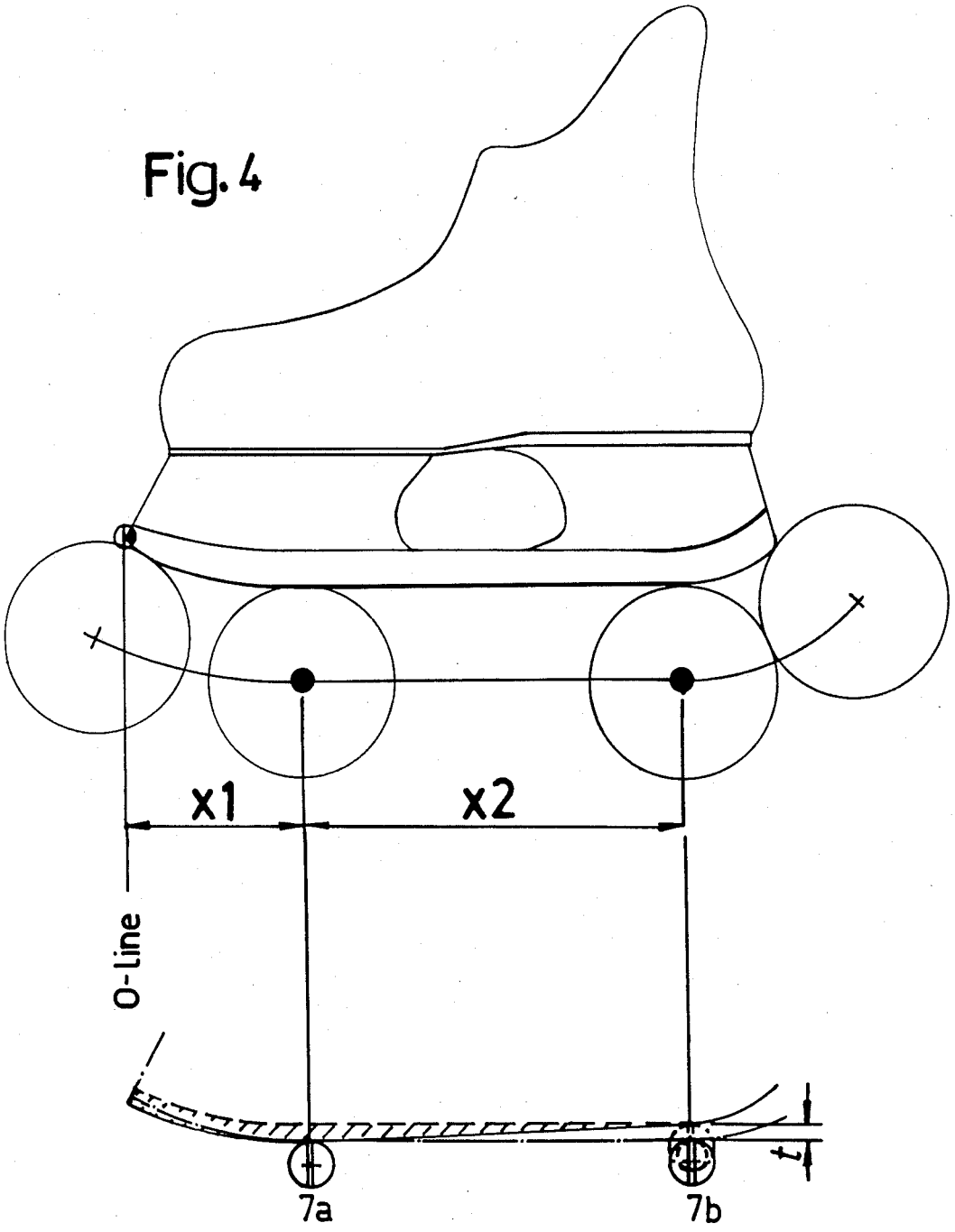
FIG. 4 illustrates schematically a particular grind process.

FIG. 4 schematically illustrates a particular grinding process obtained by completing, as mentioned above, the machine with a guidance device, for instance a key board to grind or move at least one straight portion of the grind profile. The eccentrics *7a* and *7b* make possible optional positioning or movement of at least one straight slide surface on the grind profile such that minimum machining of the skate blade is required. The grind profile recorded in the memory can through the use of for instance a key board be completed with at least two x-values x1 and x2 from the 0-line. The grinding takes place according to the recorded x- and y-values with the exception that the grinding wheel grinds along the shortest distance between x1 and x2. The number of grindings can be adapted such that the machining t to the desired grind profile x, x1, x2, y is obtained.

Figure 5:
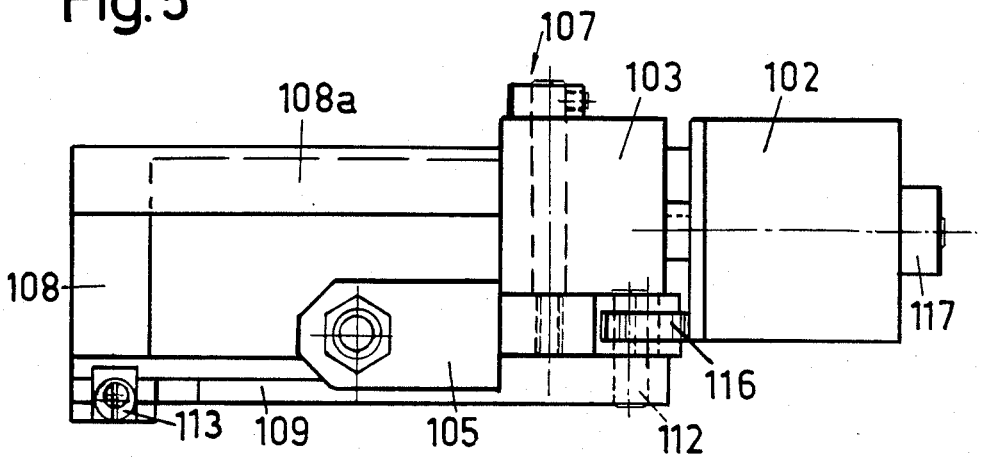
FIG. 5 shows a side view of the back portion of a skate holder in another embodiment and in greater detail.
Figure 6:
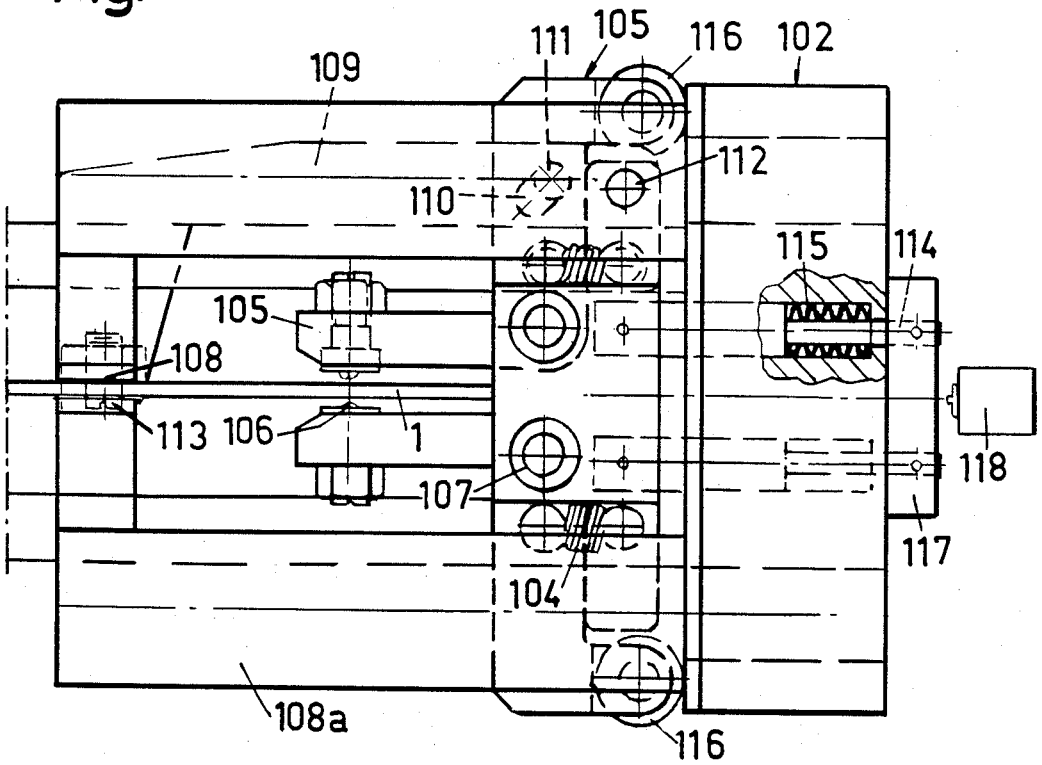
FIG. 6 shows the back portion of the skate holder seen from above.
Figure 7:
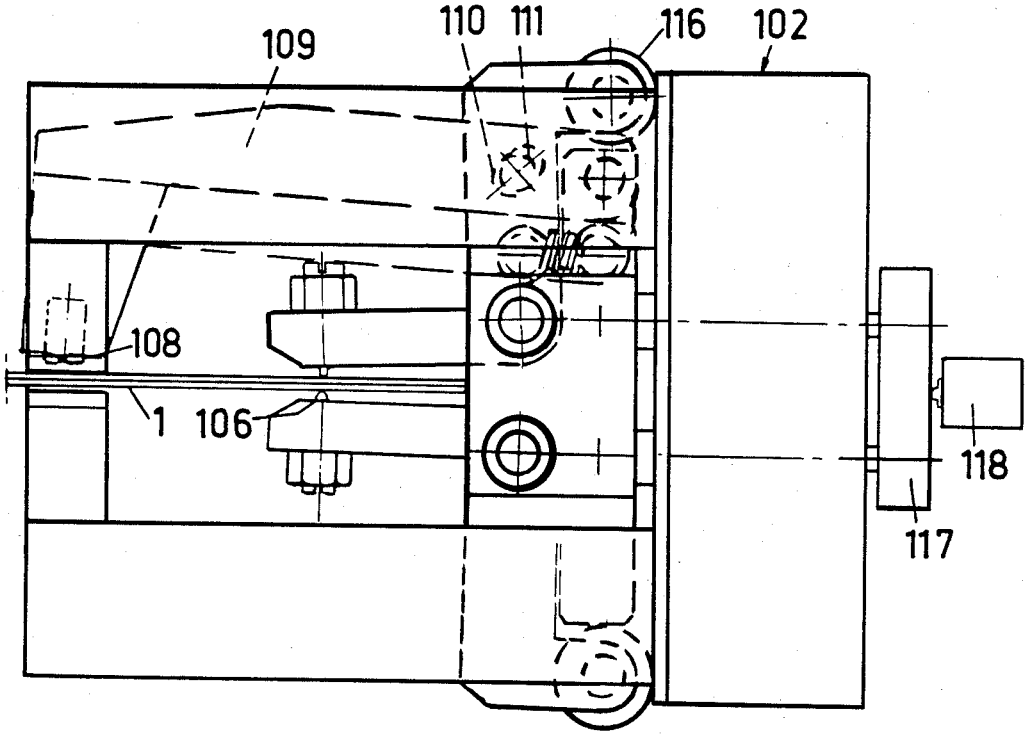
FIG. 7 shows the back portion of the skate holder of FIG. 6 in another position.

FIGS. 5–7 show a presently preferred embodiment of a skate holder according to the invention. Only one end portion of the holder is shown. The holder component 102 corresponding to the holder component 2 in a previously described embodiment, is fixed, while opposite holder component 102 corresponding to holder component 3 in the previous embodiment is running freely. Holder component 103 is arranged inside each holder component 102 and consists of two angle clamp pieces 105 provided with rolls 116, tension springs 104 and pivots 107, about which the clamp pieces 105 are pivotable. Moreover, a support arm 109 provided with an eccentric 113 in one end is arranged below the clamp pieces 105, support arm 109 is pivotable about pivot 112. The support arm 109 is in the other end provided with an oblique groove 110 which cooperates with guide pin 111. Two supports 108 connected to the holder component 102 via arms 108*a* are further arranged above the eccentric 113.

The skate is inserted with the blade end abutting against the holder component 103. The blade is guided down into correct position, adjusted by supports 108 and rests upon the excentric 113. By a handle corresponding to the handle 4 in a previously described embodiment, the freely moving holder component 102 is moved against the opposite end of the blade. Driving means corresponding to driving means 30 of the previous embodiment is activated and pulls a dog corresponding to dog 31 against the holder component 102. Force is transmitted via the skate blade to pins 114 and springs 115. Spring action rolls 116 are influenced so that the clamp pieces 105 are pivoted about the pivots 107 and the jaws 106 clamp the skate blade firmly and straighten it vertically. After a certain spring action the arm 109 is influenced and via the oblique groove 110 and the guide pin 111 the arm is pivoted outwardly. This position is shown in FIG. 7. The grinding wheel now has free passage for its operations. When maximum clamping force has been obtained between jaws 106 a plate 117 abutting the outside of the holder component 102 has reaches a limit switch 118 and the set function is ceased. The skate is locked.

Figure 8:
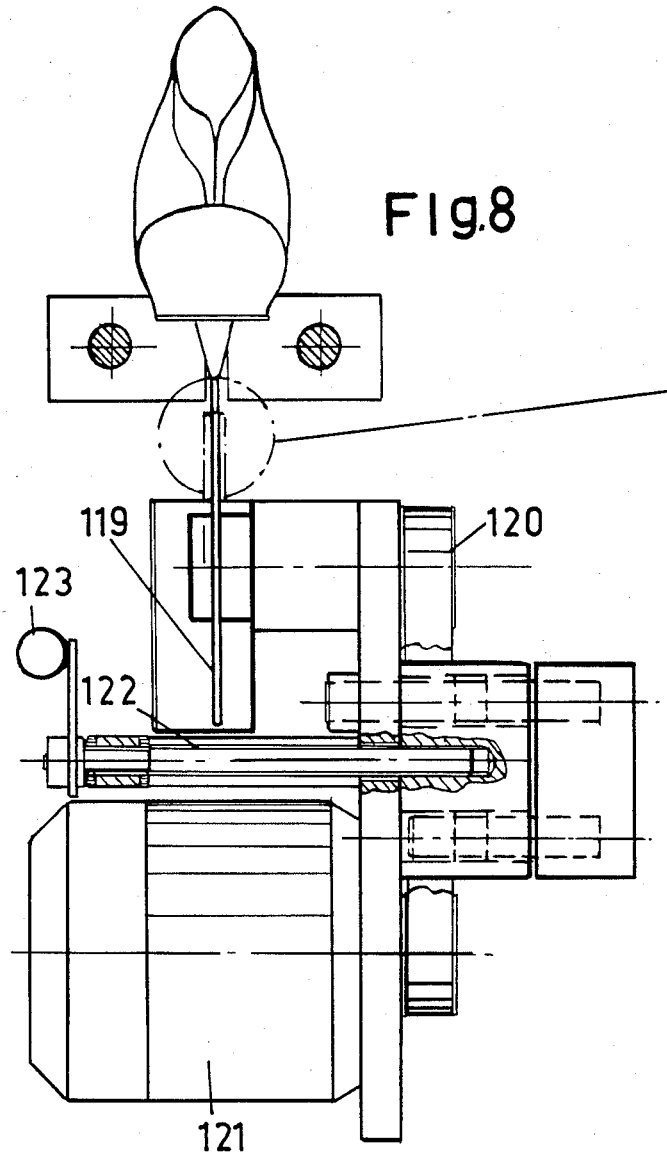
FIG. 8 illustrates schematically an adjusting device forming part of the skate holder.
Figure 9:
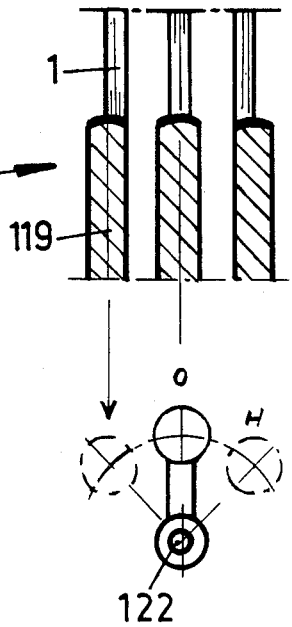
FIG. 9 shows in larger scale the encircled area in FIG. 8.

After the grinding cycle is finished the set means returns to starting position, the springs 115 press the holder component 103 back to its initial position, the springs 104 open the clamp pieces 105, and the guide pin 111 moves the arm 109 back to the starting position. FIGS. 8 and 9, show an exemplified setting means included in the skate holder to provide for unsymmetrical grind cross-sections. The grinding wheel 119 is driven by driving motor 121 by use of the transmission 120. A shaft 122 is pivotably arranged by means of a handle 123 from a symmetrical 0-position for the grinding wheel either to the left or to the right, as illustrated in FIG. 9, to an unsymmetrical V-position or H-position for the cross-section.

Figure 10:
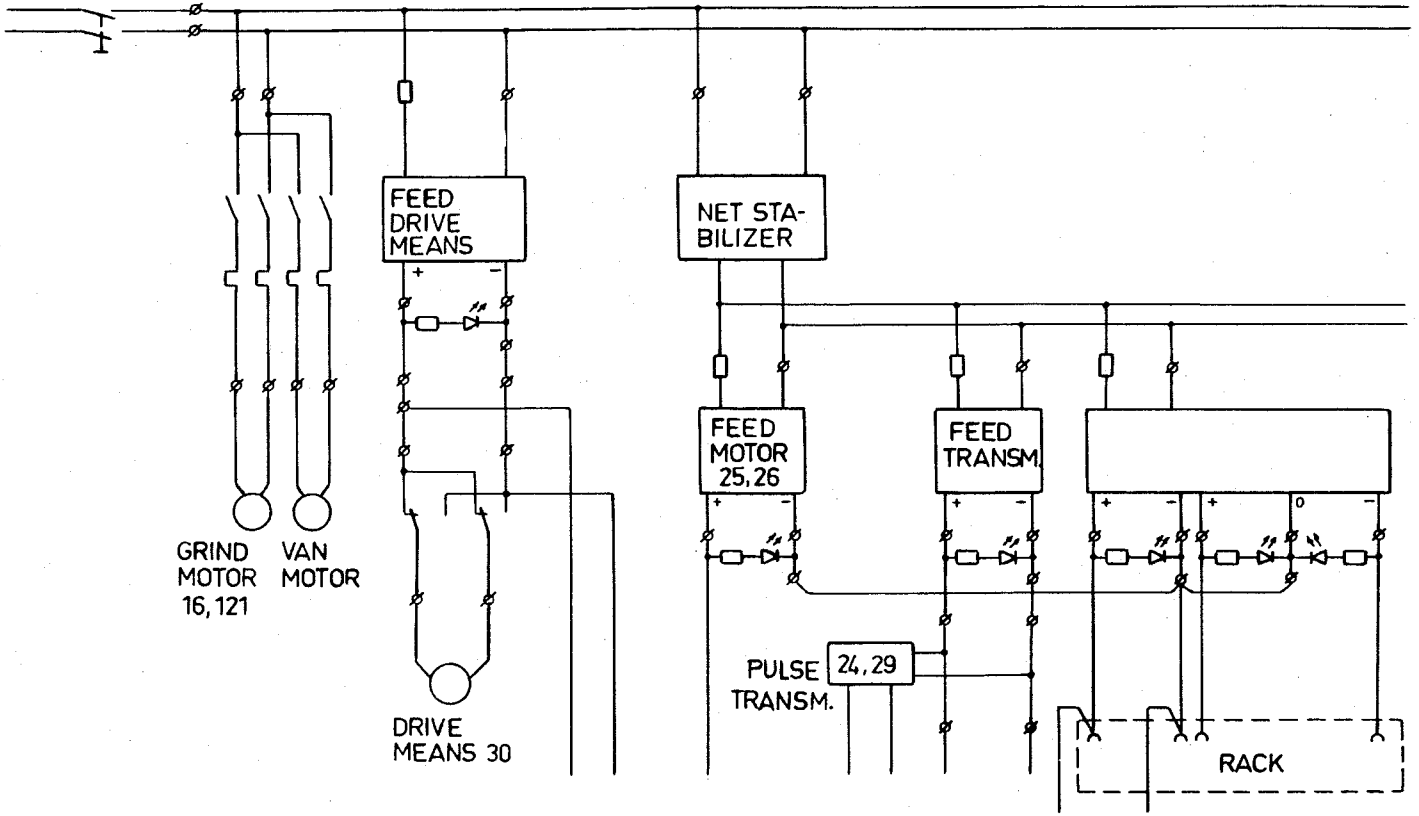
FIG. 10 shows an electrical circuit for different operations.

FIG. 10 illustrates the electrical circuit for the machine. The circuit is conventional and therefore not described.

The invention is not limited to the embodiments described above but can be modified in different ways within the framework of the following claims. Thus, the method according to the invention for instance allows that an individually obtained "successful" grind profile can be stored on for instance a magnetic card in code form and such a card can later be used for repeated grindings of the skates. The machine can furthermore be developed to a coin and note activatable automatic machine provided with means for receiving and scanning payment means, wherein after correct payment a skate-receiving space in the machine becomes available. The method according to the invention can also be developed so that a manually programmable computer, communicating with a key board, is connected to the machine. In the memory of such a computer it is possible to store information about ice, air moisture, temperature, skater's weight, type of skating to be practiced, skate manufacture, etc, and the computer calculates an appropriate grind cross-section.

What is claimed is:

1. A method for automatic sharpening the slide surface of a skate to restore the sliding surface after wearing to a desired profile with regard to at least two directions x and y in a coordinate system, one of said directions corresponding to longitudinal direction of the slide surface, using a rotatable grinding wheel, said grinding wheel and said slide surface being movable with respect to each other in said x and y directions comprising the steps of:

forcing said grinding wheel in a non-grinding state with a substantially constant contact pressure at measuring points against the slide surface for scanning and determining a plurality of x and y coordinates for the existing profile of the slide surface by moving at least one of said grinding wheel and slide surface with respect to each other in said x and y directions;

recording during said scanning the x and y coordinates in a memory;

forcing the grinding wheel in rotating grinding state against the slide surface and governing, during the machine grinding of the slide surface, the movement of the grinding wheel and the slide surface with respect to each other in response to signals from the memory estimated by the memory from the recorded x and y coordinates.

2. A method according to claim 1, further comprising a step of correcting said recorded, scanned coordinates in the memory before grinding.

3. A method according to claim 1 or 2 further comprising grinding of at least a straight slide surface optionally along a portion of the profile.

4. A method according to claim 1, further comprising a step of adjusting the grinding wheel perpendicular to the longitudinal extension of the slide surface, in z-direction in the coordinate system.

5. An apparatus for automatically sharpening the slide surface of a skate to restore the sliding surface after wearing to a desired profile with regard to at least two directions x and y in a coordinate system, one of said directions corresponding to a longitudinal direction of the slide surface, comprising:

a rotatable grinding wheel for grinding and for scanning said profile in a non-grinding state, driving means for rotating the grinding wheel, guide means for providing a relative movement between said grinding wheel and the slide surface, in said x and y directions, means for disconnecting said driving means during scanning by said grinding wheel in said non-griding state of the existing profile of said slide surface, means for exerting a substantially constant pressure of the grinding wheel against the slide surface at a plurality of measuring points during said scanning, and for determining x and y coordinates at said measuring points, means for recording in a memory said x and y coordinates corresponding to the scanned profile of said slide surface, means for connecting said driving means of the grinding wheel during a subsequent grinding operation, and means connected to said recording mens for machine grinding said slide surface to a desired profile governed by the recorded x and y coordinates.

6. An apparatus according to claim 5, including means for grinding at least a straight slide surface optionally positioned along a portion of the profile.

7. An apparatus according to claim 5 or 6, further comprising adjustment means for parallel displacement of the grinding wheel in z-direction in the coordinate system.

8. An apparatus according to claim 5, wherein said means for recording the x- and y-coordinates further comprises a marking disc and pulse transmitter.

9. An apparatus according to claim 5, further comprising means for providing access to the machine upon receiving and scanning of payment means.

10. An apparatus according to claim 5, further comprising support means for temporarily supporting the skate blade after the positioning of the skate in the machine, two support elements movable towards each other into abutment against the opposite ends of the skate blade after said positioning of the skate and means engaging the longitudinal sides of the skate blade and fixing thereof simultaneously with removing said support means and exposing the slide surface of the skate blade.

* * * * *